United States Patent [19]

Baskin

[11] Patent Number: 5,022,339

[45] Date of Patent: Jun. 11, 1991

[54] VENTILATOR FOR ATTACHMENT TO DECK HATCHES

[76] Inventor: Kermit L. Baskin, P.O. Box 197, Long Valley, N.J. 07853

[21] Appl. No.: 465,398

[22] Filed: Feb. 21, 1990

[51] Int. Cl.[5] ..... B63B 19/06

[52] U.S. Cl. ..... 114/211; 98/37

[58] Field of Search ..... 150/154; 98/37; 114/211, 361, 364

[56] References Cited

U.S. PATENT DOCUMENTS

| | | | |
|---|---|---|---|
| 4,434,740 | 3/1984 | Childs | 114/211 |
| 4,535,715 | 8/1985 | McIntosh | 114/211 |
| 4,706,593 | 11/1987 | Vail | 114/211 |
| 4,759,271 | 7/1988 | Bliemeister | 114/211 |
| 4,938,123 | 7/1990 | Hilton | 114/211 |

*Primary Examiner*—Sherman Basinger
*Assistant Examiner*—Stephan P. Avila
*Attorney, Agent, or Firm*—Hughes & Multer

[57] ABSTRACT

A ventilator for attachment to a conventional deck hatch. The ventilator has a top panel which abuts the open cover of the deck hatch so that the top panel slopes upwardly from the deck. First and second triangular side panels extend downwardly from the side edges of the top panel to the deck, and an outer front panel extends downwardly from the upper edge of the top panel to a lower edge which is a spaced distance above the deck. An inner front panel extends upwardly from the deck, and is sloped inwardly so that its upper edge is higher than, and is spaced inwardly from, the lower edge of the outer front panel, forming a passage for the entry of air. The overlap between the two front panels eliminates any direct path by which rain or sunlight could pass into the boat through the hatch opening. The panels are fabricated of waterproof cloth, and the top and outer front panels are formed with pouches which receive rigid plates; when the hatch cover is raised, it abuts the underside of the rigid plate in the top panel and raises this at an angle to the deck. A bead of welting is stitched to the lower edges of the panels at the base of the ventilator, and this is retained in a hold-down track which is mounted to the deck of the craft.

14 Claims, 3 Drawing Sheets

VENTILATOR FOR ATTACHMENT TO DECK HATCHES

FIELD OF THE INVENTION

The present invention relates generally to ventilation devices, and, more particularly, to a marine ventilator for directing the flow of fresh air into the interior of a vessel while excluding rain water and spray.

BACKGROUND OF THE INVENTION

It is frequently desirable to provide ventilation to the interior of a boat or other watercraft. Many such craft, such as motor and sailboats, are provided with deck hatches having generally planar covers which normally fit more-or-less flush with the deck, but which can be propped in an open position to admit ventilating air to the interior of the craft. Although this arrangement may facilitate a flow of air through the hatch opening, it also permits the undesirable entry of rain water and spray which are commonly present in a marine environment.

A number of ventilator devices have been proposed for deflecting or otherwise facilitating the flow of air into the deck hatch of a boat. For example, U.S. Pat. No. 4,759,271, issued to Bliemeister, discloses a scoop-like ventilator which attaches to a hatch for turning the direction of moving air so that it passes down the hatch opening. The hatch cover and opening themselves remain generally exposed so that rain and spray can readily enter the hatch opening from the sides, and wind blown rain or spray may readily follow the simple arcuate path within the scoop and enter the hatch opening. Other wind-deflecting ventilators are disclosed in U.S. Pat. No. 4,938,123 (Hilton), U.S. Pat. No. 4,706,593 (Vale, Jr.), and U.S. Pat. No. 4,434,740 (Childs), each of which involve a scoop or other deflector mechanism for changing the direction of the wind flow so that it enters the hatch opening of the boat; however, each of these devices requires the removal of the conventional hatch cover with which the craft is originally equipped, and none of these devices has any provision for preventing rain and spray from entering the hatch opening. In fact, in the devices shown in the Hilton, Vale, Jr., and Childs patents, rain may simply fall vertically into the hatch opening.

U.S. Pat. No. 4,535,715, issued to McIntosh, discloses a deck ventilator which prevents water from flowing into the compartment should the ventilator be flooded. The ventilator is formed within a low dome having a window through which outside air enters; the air then circulates past a buoyant closure member and through a series of orifices to enter a ventilation duct. If a surge of water enters the ventilator, the buoyant closure member floats upwardly to close the orifice leading to the ventilation duct. The McIntosh device appears to be intended for more severe service than that normally encountered by pleasure craft, and in any event, is a complex and expensive device which would require special installation and could not be added as an attachment to an existing boat hatch cover.

Accordingly, there still exists a need for an inexpensive and effective ventilator which is mountable to a conventional deck hatch, and which facilitates the ventilation of the interior of the craft while effectively excluding rain and spray from entering therein.

SUMMARY OF THE INVENTION

The present invention has solved the problems cited above, and comprises a ventilator for attachment to a deck hatch assembly having a hatch cover, which, when in an open position, extends upwardly at an angle from the deck. The ventilator comprises a top panel which is configured to abut an upper surface of the hatch cover when the latter is in the open position, so that a lower edge of the top panel is adjacent to the deck and first and second side edges extend at an angle from the deck to an upper edge of the top panel. First and second side panels are attached to the side edges of the top panel, and these extend downwardly to lower edges which are also adjacent to the deck. An outer front panel is attached to the upper edge of the top panel, and extends downwardly therefrom to a lower edge which is a spaced distance above the deck. An inner front panel is attached to the side panels, and extends upwardly from a lower edge adjacent to the deck to an upper edge which is above the lower edge of the outer front panel. The inner front panel has a lean-back angle so that its upper edge is spaced inwardly from the lower edge of the outer front panel, thus forming a passage which permits the flow of air between the front panels into the interior of the ventilator, but which eliminates any direct path by which rain water may enter the ventilator.

The panels are preferably fabricated of a waterproof cloth, and the top and outer front panels may preferably be formed with pouches in which rigid plates are positioned to impart rigidity to these components; the hatch cover abuts against the underside of the rigid plate in the top panel, and the top panel is thus lifted when the hatch cover is raised to the open position.

The lower edges of the top, side, and inner front panels are preferably provided with a bead of welting which is received in hold-down tracks which are secured to the deck of the boat, so that the base of the ventilator is held in position about the hatch opening.

DETAILED DESCRIPTION OF THE INVENTION

Figure 1:
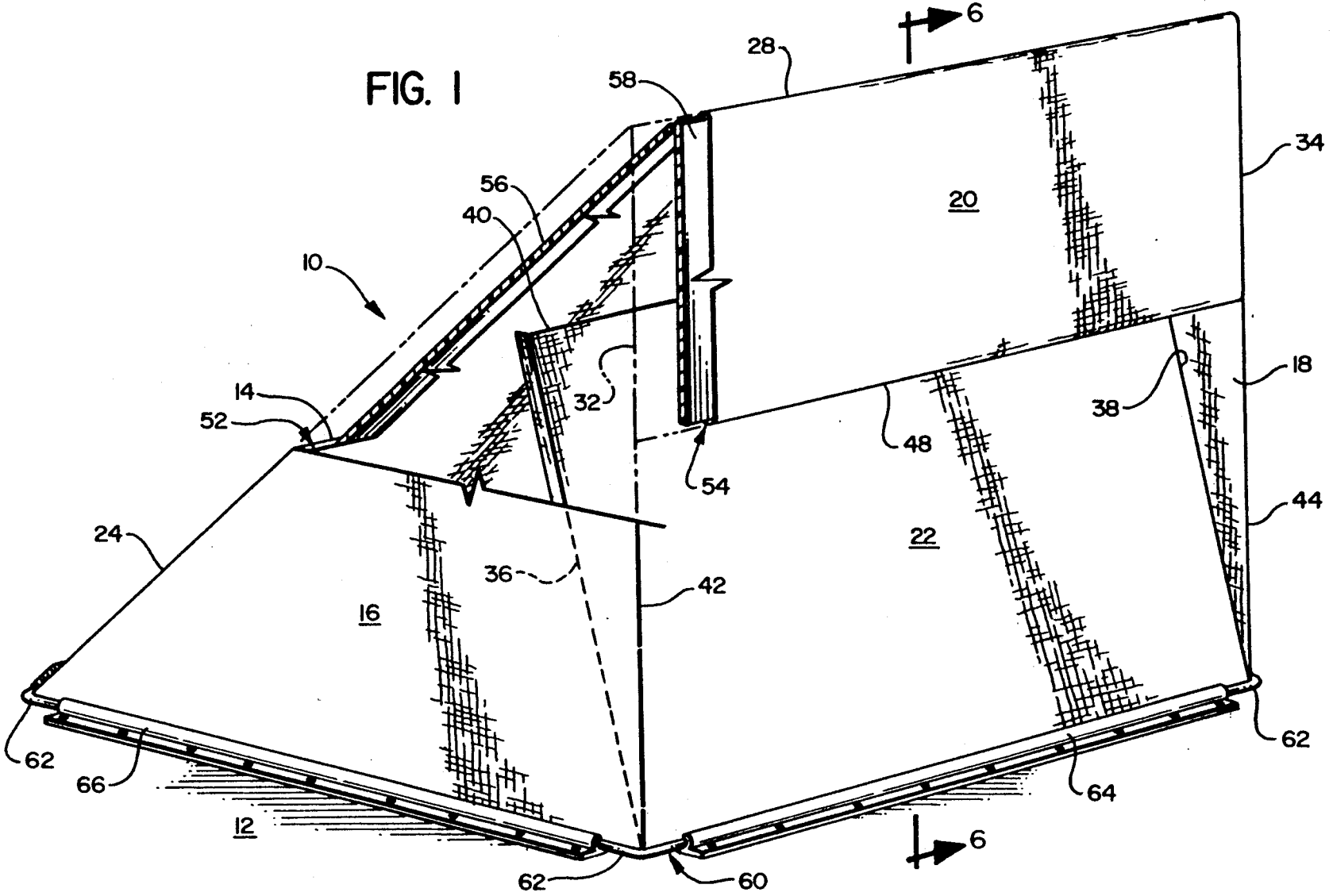
FIG. 1 is a perspective view of a ventilator incorporating the present invention, with a portion thereof cut away to show the plates which are enclosed in pockets in the ventilator to impart rigidity to the structure.

FIG. 1 shows a ventilator 10 in accordance with the present invention, mounted to the deck 12 of a water craft, such as a pleasure boat. As will become apparent from the following description, ventilator 10 is mounted over an existing, conventional hatch assembly which is set in deck 12. Ventilator 10 comprises generally a rectangular top panel 14, two triangular side panels 16 and 18, a rectangular outer front panel 20, and a rectangular, backwardly or inwardly sloping front panel 22, all preferably fabricated of a suitable flexible waterproof cloth. A waterproof cloth which has been found suitable for use in the present invention is a synthetic waterproof fabric known generally to those skilled in the art as "Acrylon".

As will be described in greater detail below, top panel 14 angles upwardly from deck 12, and is supported on its underside by the cover of the hatch. Top panel 14 is joined along its side edges 24 and 26 (24 only shown in FIG. 1) to side panels 16 and 18, respectively. Triangular side panels 16 and 18 extend vertically from the side edges of top panel 14 to deck 12. At its upper edge 28, top panel 14 is joined to a corresponding edge of front panel 20, which extends across the front of ventilator 10, and which is joined at its side edges 32 and 34 to the corresponding vertical edges of triangular side panels 16 and 18, respectively.

Inwardly sloping front panel 22, in turn, is also attached along its edges 36 and 38 to side panels 16 and 18. Panel 22 is angled inwardly at its upper edge 40 so that its edges 36 and 38 extend upwardly from the lower front corners of triangular side panels 16 and 18 at an angle away from the vertical front edges 42 and 44 of the side panels. The upper edge 40 of inner front panel 22 extends above (i.e., higher than) the lower edge 48 of outer front panel 20, and, as will become apparent from the description provided below, this arrangement serves to permit the passage of air through ventilator 10 while excluding water such as rain or spray.

Top panel 14 and front panel 20 are formed with integral pockets 52 and 54, which receive rigid plates 56 and 58. Plates 56 and 58 impart rigidity to their respective fabric panels, and may be formed of any suitable rigid, preferably waterproof material, such as plastic or wood.

The bottom edges of panels 14, 16, 18, and 22 extend flush with deck 12 along a common base, as indicated generally by reference numeral 60, and a bead of welting 62 is attached along a lower edges of the panels at base 60. Welting 62 may be formed of any suitable material having suitable strength and resistance to wear, such as vinyl welting. The bead of welting 62 is received in hold-down tracks 64, 66, 68 and 70 (64 and 66 only shown in FIG. 1), which, in turn, are bolted or otherwise secured to deck 12 to hold the base 60 of the ventilator 10 flush against the deck. As will be described below, the top panel 14 and its associated plate 56 are supported in an upward direction by the underlying hatch cover, so that tension applied between the top panel 14 and the base 60 holds ventilator 10 in its proper form with the components in their desired positions.

The seams at which the fabric panels meet may be formed by any suitable method, such as, for example, by conventional stitching.

Figure 2:
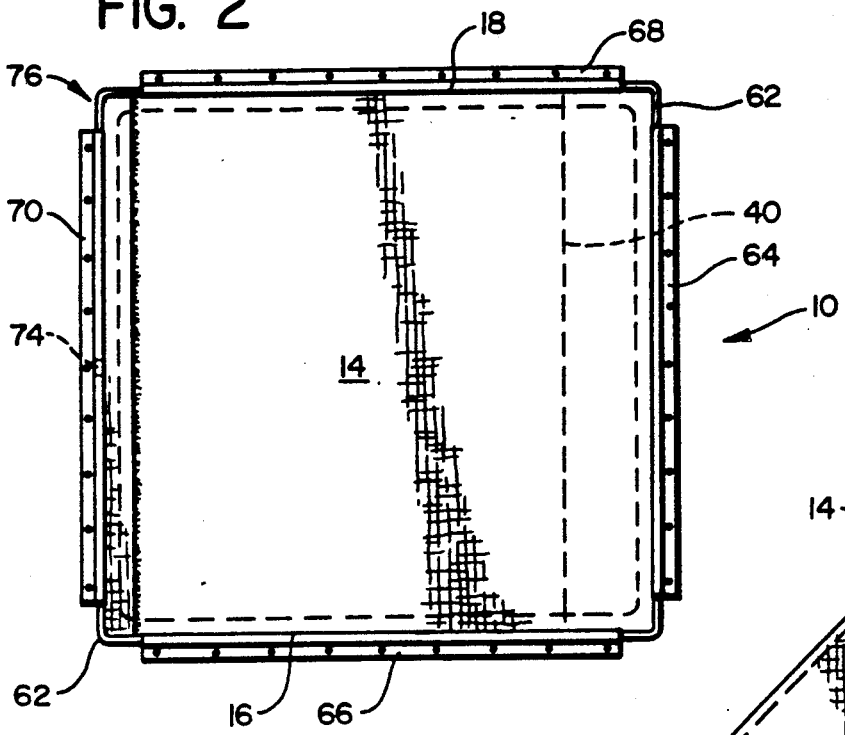
FIG. 2 is an overhead plan view of the ventilator of FIG. 1.

As is apparent from the overhead view of ventilator 10 in FIG. 2, the lower edges of panels 14, 16, 18, and 22 are joined at right angles to one another so that base 60 is substantially square in shape, this square being sized to fit over a selected conventional deck hatch assembly. FIG. 2 also shows the separate hold-down tracks 64, 66, 68, and 70 which receive and retain the welting 62. So as to facilitate the installation of the welting in the hold-down tracks, the start and finish seam is left open by approximately one-quarter of an inch, and this opening is preferably positioned so that, when the welting is installed, the opening is positioned in the back hold-down track 70 in the location indicated by broken line image 74. In some embodiments of the present invention, however, it may be desirable to form the hold-down track as a one-piece wrap-around track (instead of as four separate tracks); in this case, it will be necessary to leave an opening in the track of perhaps one-half inch, at the location indicated generally by arrow 76, so that the welting can be threaded into the hold-down track.

Figure 3:
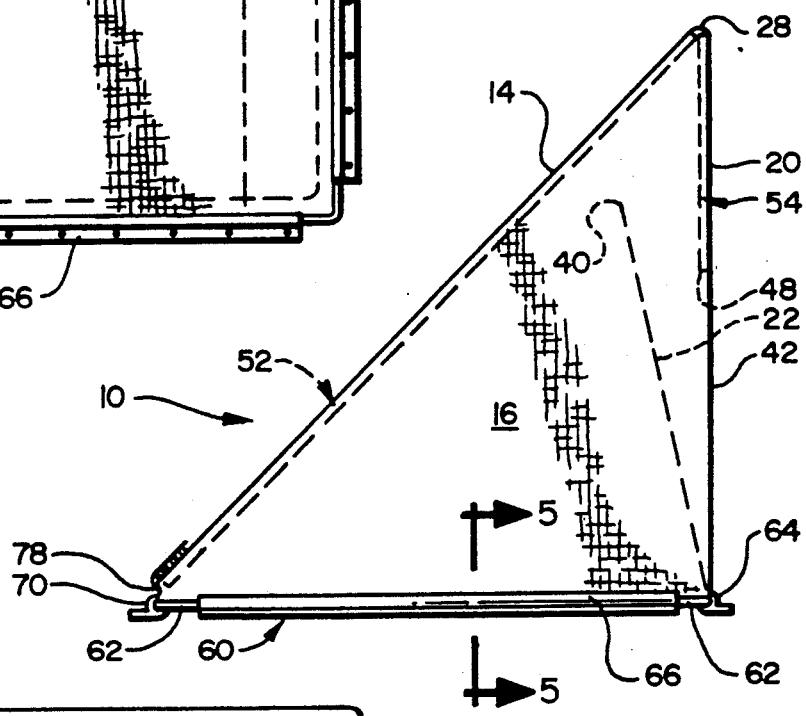
FIG. 3 is a side elevational view of the ventilator of FIG. 1.
Figure 4:
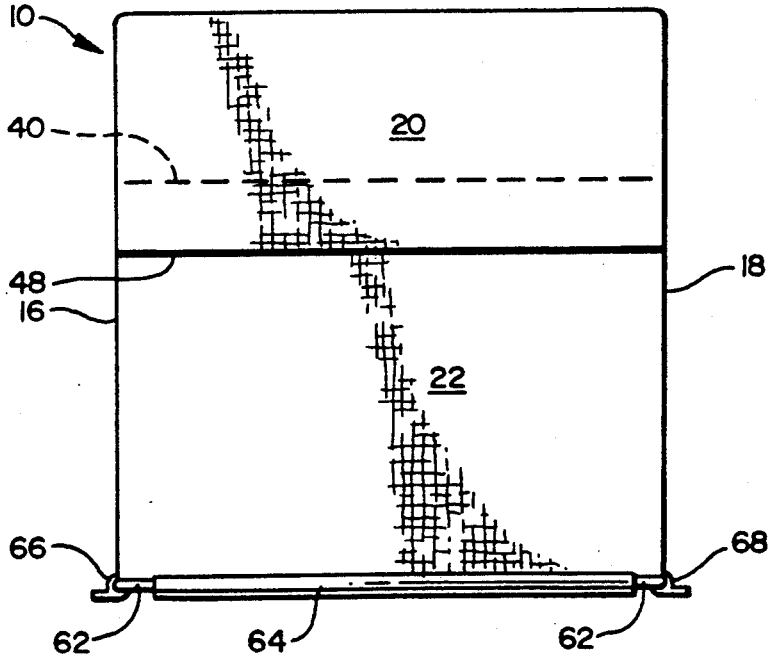
FIG. 4 is a front elevational view of the ventilator of FIG. 1.

FIG. 3 clearly shows the arrangement of inner front panel 22 which slopes back, or inwardly, from the parallel leading edges 42 and 44 of the triangular side panels 16 and 18. Also shown in both FIGS. 3 and 4 is the overlap of the edges of the outer and inner front panels of the ventilator, the lower edge 48 of outer front panel 20 extending well below the upper edge 40 of inner front panel 22. As is also apparent from FIG. 3, the pocket 54 which is formed in outer front panel 20 extends vertically within that panel, and the pocket 52 which is formed in top panel 14 extends the full length of panel 14, from its upper edge 28 to its lower edge 78 proximate base 60.

Figure 5:
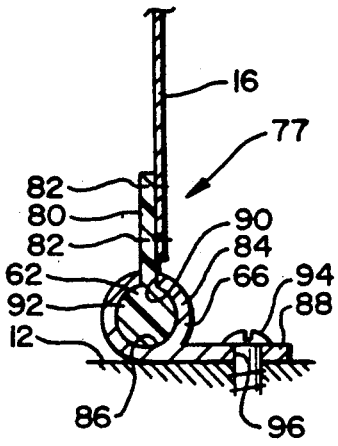
FIG. 5 is a view of a vertical section taken through a portion of the ventilator shown in FIG. 3, showing the mounting of the fabric material thereof in a slotted track which retains the base of the ventilator to the deck of the vessel.

FIG. 5 shows the arrangement for holding the base 60 of ventilator 10 against deck 12. As with each of the other panels, the lower edge portion of fabric panel 16, as indicated generally by arrow 77, is attached to an upwardly extending strip portion 80 of the welting 62 by stitching 82. Hold-down track 66, in turn, comprises an elongate channel portion 84, having a cylindrical bore 86, and a horizontally extending flange portion 88. At the top of bore 86 is a longitudinally extending slit 90 which passes through the wall of channel portion 84. A cylindrical bead portion 92 of welting 62 is received and retained in bore 86, and the strip portion 80 of welting 62 extends vertically out of slit 90. Accordingly, it will be understood that the fabric panels of ventilator 10 can be quickly and easily installed in the hold-down tracks by threading the cylindrical bead portion 92 into the cylindrical bore 86, so that the strip portion of the welting is positioned in the slit 90, and then sliding the welting longitudinally along the hold-down track. The hold-down track 66 itself is fixed to deck 12 by means of bolts 94 which pass through cooperating holes 96 in the flange portion 88 of the hold-down track.

Figure 6:
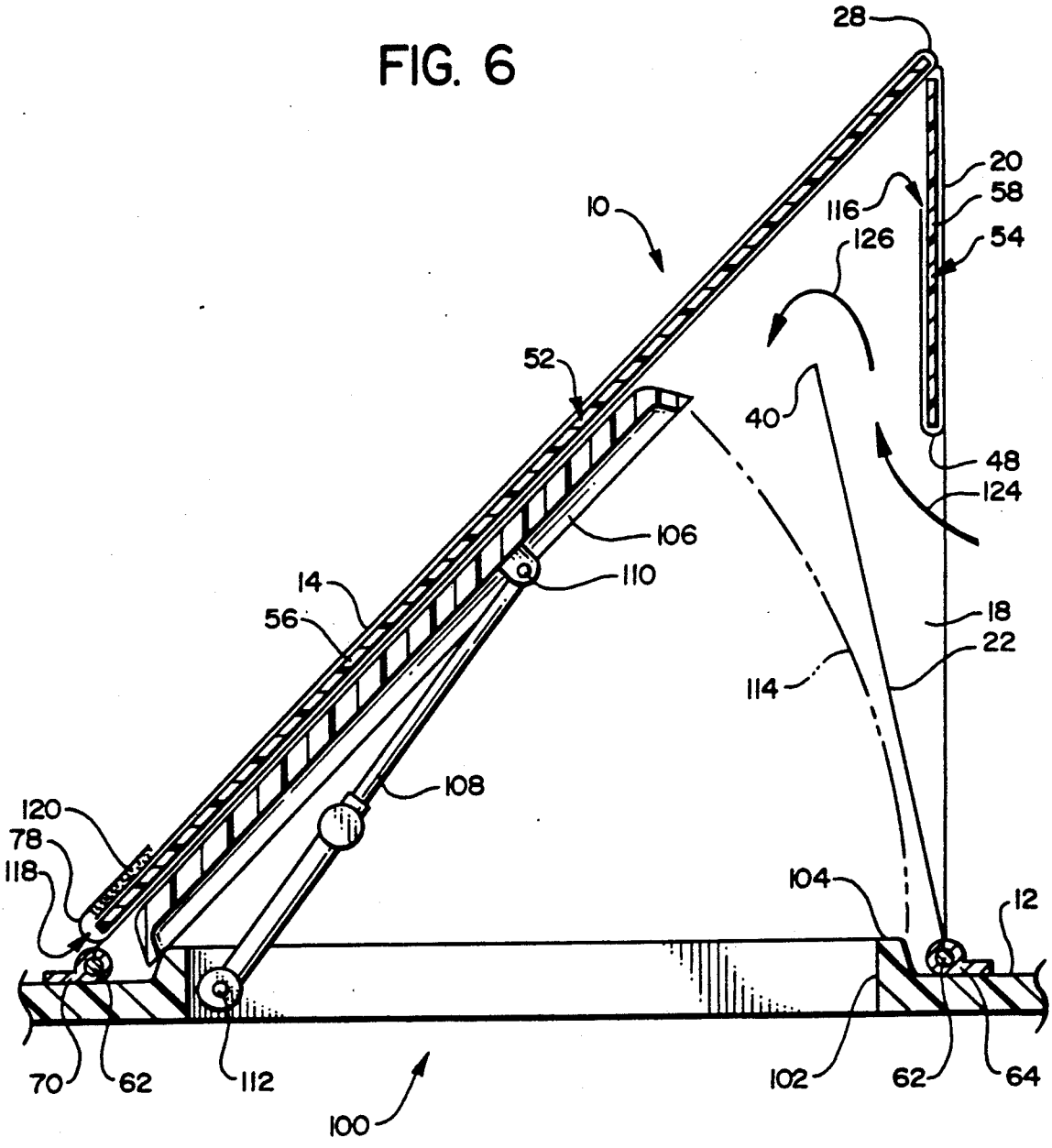
FIG. 6 is a side view of a vertical section taken longitudinally through the center of the ventilator of FIG. 1.

FIG. 6 shows a conventional small craft deck hatch assembly, as indicated generally by reference numeral 100, which is suitable for use with the ventilator 10 of the present invention. Deck hatch assembly 100 comprises generally a hatch opening 102 which passes through deck 12, and which has a peripheral combing 104, against which cover 106 seats when in the lowered position. Hatch cover 106 is connected to a conventional adjustable locking arm 108 at pivot point 110, locking arm 108, in turn, being pivotably attached to combing 104 at pivot point 112 so that the hatch cover is pivotable between a closed and opened position, as indicated by arcuate path 114.

To install ventilator 10 on hatch assembly 100, rigid plate 58 is first slipped into the pocket 54 in outer front panel 20 through an opening 116 which is provided on the inside of the panel. The welting 62 at the base edges of fabric panels 14, 16, 18, and 22 is then threaded into the hold-down tracks on deck 12 as previously described. The large top plate 56 is then slid into the top pocket formed in top panel 14, through the opening 118 which is provided in the back of panel 14 at its lower edge 78. The opening 118 of pocket 52 is then closed using Velcro TM closures 120. Next, the hatch cover 106 is raised as far as possible, so that it abuts the underside of rigid plate 56 and raises top panel 14 lo apply upward tension against the welting in the hold-down tracks, which positions the panels of ventilator 10 in proper relationship to one another. The arm 108 is then locked in position to hold ventilator 10 in shape. An air passage is thus formed between the overlapped front panels, by which air can enter beneath the lower edge 48 of panel 20 and pass over the upper edge 40 of panel 22, which is spaced inwardly from edge 48 due to the lean-back angle of panel 22. The incoming air consequently flows first upwardly, in the direction indicated by arrow 124, and then changes direction around the upper edge 40 of panel 22, as indicated by arrow 126, to flow downwardly through hatch opening 102 into the interior of the vessel. It will be appreciated that the overlap of the lower edge 48 of panel 20 and the upper edge 40 of panel 22 thus eliminates any direct path by which rain or spray could reach the interior of the boat, and the initial upward flow of the air path, followed by the change in direction to go back downwardly into the boat, helps to provide additional protection to ensure that wind-borne rain and mist do not enter the interior of the boat by this route. Furthermore, this arrangement prevents any direct rays from the sun from reaching the interior of the boat.

To remove ventilator 10 from hatch assembly 100, the above-described process is simply reversed, beginning with unlocking and lowering hatch cover 106. The bead of welting 162 can then be slid out of the hold-down tracks, and the rigid panels 56 and 58 removed from their respective pockets, so that the remaining fabric panels can be folded up without damage to a very small size for convenient storage.

Accordingly, it will be appreciated that the present invention has provided an inexpensive and effective ventilator which excludes rain and sun rays from entering the hatch opening, and which is of a semi-flexible construction which facilitates easy installation, take-down, and storage.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of the equivalency of the claims are therefore intended to be embraced therein.

I claim:

1. A ventilator for attachment to a deck hatch having a hatch cover which opens to uncover a hatch opening so that the interior of said ventilator is in communication with said hatch opening, said ventilator comprising:

a rigid top panel configured so that when said ventilator is attached to said deck hatch, a lower edge of said top panel is adjacent said deck and first and second side edges of said top panel extend upwardly from said deck to an upper edge of said top panel which is a spaced distance above said deck;

first and second side panels, each said side edge of said top panel having a said side panel attached thereto, each said side panel being configured to extend downwardly from a said upwardly extending side edge of said top panel to a lower edge which is adjacent to said deck;

an outer front panel having an upper edge attached to said upper edge of said top panel, said outer front panel being configured to extend downwardly from said upper edge of said top panel which is a spaced distance above said deck to a lower edge which is also a spaced distance above said deck; and an inner front panel configured to extend upwardly from a lower edge which is adjacent to said deck to an upper edge which is no lower than said lower edge of said outer front panel which is a spaced distance above said deck, and so that said upper edge of said inner front panel is displaced inwardly from said lower edge of said outer front panel so as to from a gap between said inner and outer front panels which permits the flow of air into said interior of said ventilator, but which eliminates any direct path by which rain might enter said hatch opening via said ventilator.

2. The ventilator of claim 1, further comprising means for attaching each said lower edge of said upper, side, and inner front panels to said deck.

3. The ventilator of claim 2, wherein said rigid top panel is configured to abut an upper side of said hatch cover so that said top panel is supported by said hatch cover with said upper edge of said top panel a spaced distance above said deck when said hatch cover is in an open position.

4. The ventilator of claim 3, wherein said panels are fabricated of waterproof cloth.

5. The ventilator of claim 4, wherein said rigid top panel comprises:

a pouch formed of said waterproof cloth; and a rigid plate positioned in said pouch.

6. The ventilator of claim 5, wherein said outer front panel comprises:

a pouch formed of said waterproof cloth; and a rigid plate positioned in said pouch.

7. The ventilator of claim 4, wherein said means for attaching each said lower edge of said upper, side, and inner front panels to said deck comprises:

a bead of welting attached to each said lower edge of said upper, side, and inner front panels; and a hold-down track mounted to said deck, said hold-down track being configured so that said bead of welting is slidably receivable in said hold-down track so that said bead of welting is retained therein.

8. A ventilator for attachment to a deck hatch having a hatch cover which, when in an open position, extends upwardly at an angle from a deck to uncover a hatch opening in said deck for communication with the interior of said ventilator, said ventilator comprising:

a top panel configured to abut an upper surface of said hatch cover in said open position so that said top panel is supported by said open hatch cover with a lower edge of said top panel adjacent to said deck and first and second side edges of said top panel extending upwardly at an angle from said deck to an upper edge of said top panel which is a spaced distance above said deck;

first and second side panels, each said side edge of said top panel having a said side panel attached thereto, each said side panel being configured to extend downwardly from a said upwardly extending side edge of said top panel to a lower edge which is adjacent to said deck;

an outer front panel attached to said upper edge of said top panel and configured to extend downwardly from said upper edge of said top panel which is a spaced distance above said deck to a lower edge which is also a spaced distance above said deck; and an inner front panel which is configured to extend upwardly from a lower edge which is adjacent to said deck to an upper edge which overlaps and is spaced inwardly from said lower edge of said outer front panel which is a spaced distance above said deck, so as to form a passage which permits the flow of air between said front panels into said interior of said ventilator, but which eliminates any direct path by which rainwater might enter said hatch opening via said interior of said ventilator.

9. The ventilator of claim 8, wherein said upper edge of said inner front panel which overlaps said lower edge of said outer front panel is positioned higher than said lower edge of said outer front panel, so that said flow of air between said front panels travels beneath said lower edge of said outer front panel and upwardly between said outer and inner front panels, and then over said upper edge of said inner front panel and downwardly through said interior of said ventilator into said hatch opening in said deck.

10. The ventilator of claim 9, wherein said top panel is a substantially rigid, planar panel.

11. The ventilator of claim 10, wherein said top panel comprises:

a substantially planar pouch formed of flexible fabric; and a rigid plate positioned within said pouch so as to impart rigidity to said top panel.

12. The ventilator of claim 11, wherein said side and inner front panels are formed of flexible fabric.

13. The ventilator of claim 12, wherein said top panel further comprises:

a portion of said top panel forming an opening in said pouch adjacent to said lower edge of said top panel for selective removal and insertion of said rigid plate; and Velcro closures across said opening for selectively closing said opening to retain said rigid plate in said pouch in said to panel.

14. The ventilator of claim 12, further comprising means for detachably attaching each said lower edge of said top, side, and inner front panels to said deck.

* * * * *